US008050910B2

(12) United States Patent
Joublin et al.

(10) Patent No.: US 8,050,910 B2
(45) Date of Patent: Nov. 1, 2011

(54) PITCH EXTRACTION WITH INHIBITION OF HARMONICS AND SUB-HARMONICS OF THE FUNDAMENTAL FREQUENCY

(75) Inventors: Frank Joublin, Mainhausen (DE); Martin Heckmann, Frankfurt am Main (DE)

(73) Assignee: Honda Research Institute Europe GmbH, Offenbach/Main (DE)

( * ) Notice: Subject to any disclaimer, the term of this patent is extended or adjusted under 35 U.S.C. 154(b) by 888 days.

(21) Appl. No.: 12/037,892

(22) Filed: Feb. 26, 2008

(65) Prior Publication Data

US 2008/0234959 A1 Sep. 25, 2008

(30) Foreign Application Priority Data

Mar. 23, 2007 (EP) ..... 07104807

(51) Int. Cl.
*G10L 11/04* (2006.01)

(52) U.S. Cl. ..... 704/207; 704/205; 704/217

(58) Field of Classification Search ..... 704/205, 704/207, 217

See application file for complete search history.

(56) References Cited

U.S. PATENT DOCUMENTS 5,890,108 A 3/1999 Yeldener

FOREIGN PATENT DOCUMENTS

EP 1 686 561 A1 2/2006

OTHER PUBLICATIONS

H. Duifhuis et al., *Measurement of pitch in speech: An implementation of Goldstein's theory of pitch perception*, The Journal of the Acoustical Society of America, Jun. 1982, pp. 1568-1580, vol. 71, No. 6.

European Search Report for application No. 07104807.8-2225, Jul. 30, 2007, 13 pages.

Martin Heckmann et al., *Sound Source Separation for a Robot Based on Pitch*, 2005 IEEE/RSJ International Conference on Intelligent Robots and Systems, Aug. 2-6, 2005, pp. 2197-2202.

Wolfgang Hess, *Pitch Determination of Speech Signals: Algorithms and Devices*, 1983, pp. 416-434, published by Springer-Verlag.

Guoning Hu et al., *Monaural Speech Segregation Based on Pitch Tracking and Amplitude Modulation*, IEEE Transactions on Neural Networks, Sep. 2004, pp. 1135-1150, vol. 15, No. 5.

Marek Szczerba et al., *Pitch Detection Enhancement Employing Music Prediction*, Journal of Intelligent Information Systems, 2005, pp. 223-251.

*Primary Examiner* — Vincent P Harper
(74) *Attorney, Agent, or Firm* — Fenwick & West LLP

(57) ABSTRACT

The fundamental frequency of a harmonic signal is estimated by forming a fundamental frequency hypothesis (f0'). A comb filter is provided based on the fundamental frequency hypothesis. The harmonic signal is filtered using the comb filter. The fundamental frequency hypothesis is tested for each tooth in the comb filter. A signal indicating an estimated fundamental frequency of the provided harmonic signal may be outputted based on the testing.

14 Claims, 4 Drawing Sheets

(b)

(a)

PITCH EXTRACTION WITH INHIBITION OF HARMONICS AND SUB-HARMONICS OF THE FUNDAMENTAL FREQUENCY

FIELD OF INVENTION

The present invention is related to processing of signals, and particularly to a technique for finding the fundamental frequency of a harmonic signal. This invention is also related to the field of separating acoustic sound sources in monaural recordings, voiced/unvoiced decision, or gender detection based on the fundamental frequency.

BACKGROUND OF THE INVENTION

Speech signals contain many harmonic parts. Once identified, the fundamental frequency of these harmonic parts can be used for various purposes. One application of the identified fundamental frequency is separation of sound sources. During recording, sounds from multiple sound sources may be recorded simultaneously. The sounds from multiple sound sources include different speech signals, noises (for example, noises from fans) or other similar signals. To further analyze the signals, it is first necessary to separate interfering signals. The identified fundamental frequency can also be used for speech recognition and acoustic scene analysis.

There are various conventional methods of determining the fundamental frequency of harmonic signals. One widely used approach is using the autocorrelation function described, for example, in G. Hu and D. Wang, "Monaural speech segregation based on pitch tracking and amplitude," IEEE Trans. On Neural Networks, 2004. In this approach, the signal is split into frequency bands by using a set of band pass filters. For each frequency band, the auto-correlation is determined and frequencies in a harmonic relation share the time peaks in the lag domain. Peaks also occur at the lag corresponding to multiples and partials of the true lag. These additional peaks interfere with the main peak when determining the fundamental frequency.

U.S. patent application Ser. No. 11/340,918 filed on Jan. 26, 2006, entitled "Determination of a common Fundamental Frequency of Harmonic Signals" by the same inventors describes a method of replacing the auto-correlation with the calculation of the distances between zero crossings of several orders in the individual frequency channels that also share peaks in the lag/distance domain. In other words, the fundamental frequency of the channels is estimated by calculating the zero crossing distances. If harmonics originate from the same fundamental frequency, the harmonics share zero crossing distances.

As described in U.S. patent application Ser. No. 11/340,918 and the article by Martin Heckmann and Frank Joublin, "Sound Source Separation for a Robot Based on Pitch," International Conference on Intelligent Robots and Systems (IROS), Edmonton, Canada, pp. 203-208 (August 2005), the distance between two zero crossings in the channel of the fundamental frequency can be found again as the distance between three zero crossings in the first harmonic and the distance between four zero crossings in the second harmonic.

These distances between three or four zero crossings will also be referred to as higher order zero crossing distances, second and third order, respectively. In this case, however, spurious side peaks emerge.

An article by H. Duifhuis and R. Sluyter, "Measurement of pitch in speech: An implementation of Goldstein's theory of pitch perception," J. Acoust. Soc. Am. pp. 1568-80, (1982) discloses using a different approach. This article describes using a comb filter, also called 'harmonic sieve,' set up with teeth at the fundamental frequency and its harmonics. The energy at each tooth is summed up for different fundamental frequency hypotheses. When the hypothesis and the true fundamental frequency coincide, all the teeth in the comb have high energy, resulting in a maximum. In previous methods, side peaks again occur at the harmonics and sub-harmonics of the true fundamental frequency.

SUMMARY OF THE INVENTION

Embodiments of the present invention provide a method for estimating the fundamental frequency of a harmonic signal by forming a fundamental frequency hypothesis (f0'). A comb filter is provided based on the fundamental frequency hypothesis. The harmonic signal is then filtered by the comb filter. The fundamental frequency hypothesis is tested for each tooth in the comb filter. A signal indicating an estimated fundamental frequency of the provided harmonic signal may be outputted based on the testing.

In one embodiment, the fundamental frequency hypothesis (f0') may be formed based on the sampling resolution of the signal. The comb filter may contain the fundamental frequency hypothesis (f0') and its possible harmonics.

In one embodiment, testing the fundamental frequency hypothesis may comprise comparing the difference between a first value in the tooth of the comb filter and a second value predicted from the fundamental frequency hypothesis with a predetermined threshold value.

In one embodiment, the fundamental frequency hypothesis may be tested by comparing the difference between a predetermined threshold value and the distances between zero crossings of the signal at the tooth of the comb filter and the distances between zero crossings of the signal predicted from the fundamental frequency hypothesis. In another embodiment, the fundamental frequency hypothesis may be tested by comparing a predetermined threshold value with the difference between the position of the peak in an autocorrelation of the signal at the tooth of the comb filter and the position of the peak of the autocorrelation of the signal predicted from the fundamental frequency hypothesis. In both cases, the threshold value may be set adaptively depending on disturbances present in the signal.

In one embodiment, a weight is assigned to the current fundamental frequency hypothesis based on prototypical allocation patterns of the teeth of the comb filter for harmonics and sub-harmonics. Additionally, the correct allocation may be amplified in a non-linear manner. The weight may also depend on the energy of the signal at the tooth of the comb filter.

In one embodiment, a histogram of the calculated weights may be built for each time interval.

In one embodiment, the method is used for canceling the harmonics or sub-harmonics of the fundamental frequency in a harmonic signal.

In one embodiment, the method is employed to improve the results in the extraction of the fundamental frequency of a harmonic signal. For example, problematic spurious side peaks at harmonics and sub-harmonics of the true fundamental frequency are significantly reduced.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

BRIEF DESCRIPTION OF THE FIGURES

The teachings of the present invention can be readily understood by considering the following detailed description in conjunction with the accompanying drawings.

DETAILED DESCRIPTION OF THE INVENTION

Figure 1:
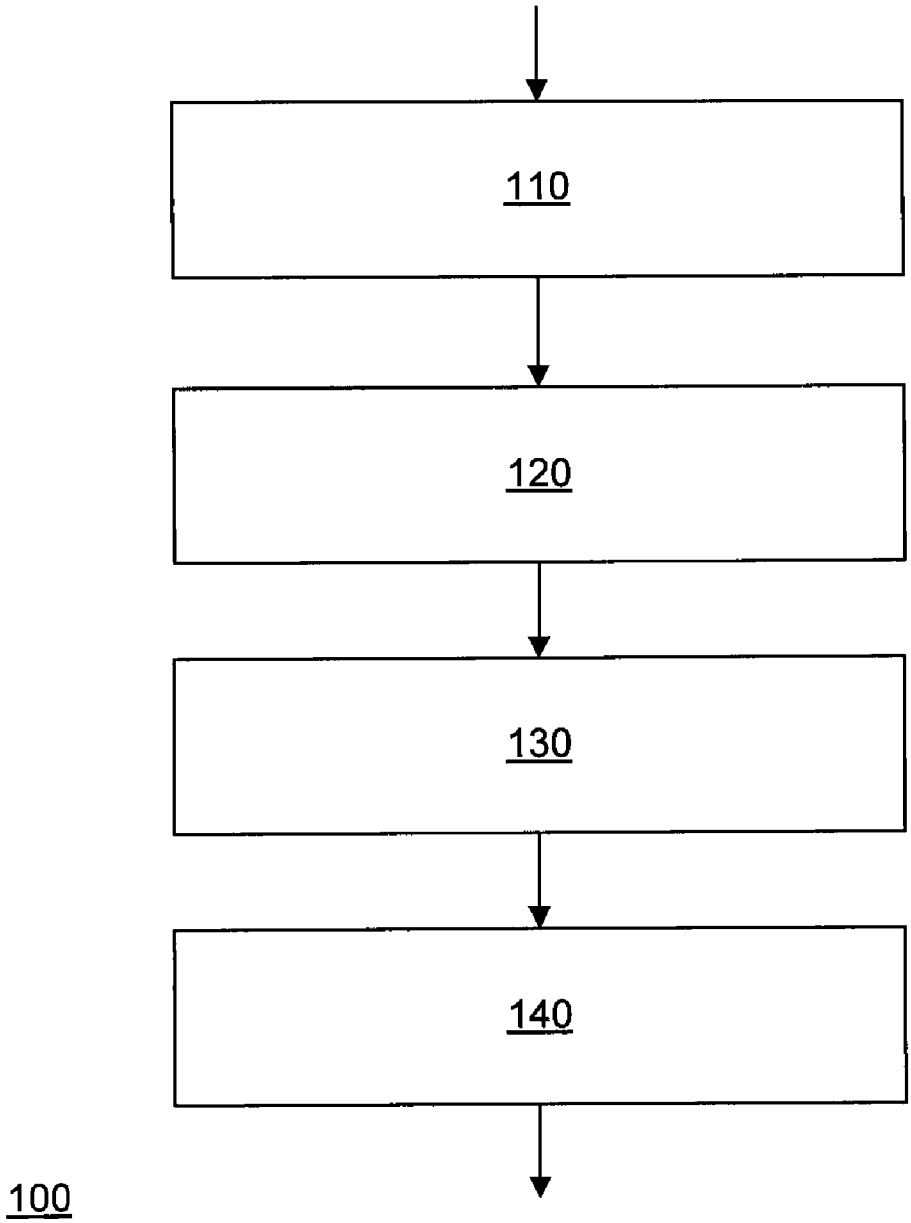
FIG. 1 is a flowchart illustrating a method of estimating the fundamental frequency of a harmonic signal, according to one embodiment of the invention.

Reference in the specification to "one embodiment" or to "an embodiment" means that a particular feature, structure, or characteristic described in connection with the embodiments is included in at least one embodiment of the invention. The appearances of the phrase "in one embodiment" in various places in the specification are not necessarily all referring to the same embodiment.

Some portions of the detailed description that follows are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic or optical signals capable of being stored, transferred, combined, compared and otherwise manipulated. It is convenient at times, principally for reasons of common usage, to refer to these signals as bits, values, elements, symbols, characters, terms, numbers, or the like. Furthermore, it is also convenient at times, to refer to certain arrangements of steps requiring physical manipulations of physical quantities as modules or code devices, without loss of generality.

However, all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or "determining" or the like, refer to the action and processes of a computer system, or similar electronic computing device, that manipulates and transforms data represented as physical (electronic) quantities within the computer system memories or registers or other such information storage, transmission or display devices.

Certain aspects of the present invention include process steps and instructions described herein in the form of an algorithm. It should be noted that the process steps and instructions of the present invention could be embodied in software, firmware or hardware, and when embodied in software, could be downloaded to reside on and be operated from different platforms used by a variety of operating systems.

The present invention also relates to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Furthermore, the computers referred to in the specification may include a single processor or may be architectures employing multiple processor designs for increased computing capability.

The algorithms and displays presented herein are not inherently related to any particular computer or other apparatus. Various general-purpose systems may also be used with programs in accordance with the teachings herein, or it may prove convenient to construct more specialized apparatus to perform the required method steps. The required structure for a variety of these systems will appear from the description below. In addition, the present invention is not described with reference to any particular programming language. It will be appreciated that a variety of programming languages may be used to implement the teachings of the present invention as described herein, and any references below to specific languages are provided for disclosure of enablement and best mode of the present invention.

In addition, the language used in the specification has been principally selected for readability and instructional purposes, and may not have been selected to delineate or circumscribe the inventive subject matter. Accordingly, the disclosure of the present invention is intended to be illustrative, but not limiting, of the scope of the invention, which is set forth in the following claims.

FIG. 1 is a flowchart of a method 100 for estimating the fundamental frequency of a harmonic signal, according to one embodiment of the invention. In step 110, a hypothesis regarding the fundamental frequency of a given harmonic signal is formed. In step 120, a comb filter is generated or set up based on the fundamental frequency hypothesis formed in step 110. As well known to a person skilled in the art, the shape of the transfer function of a comb filter resembles a hair comb. Specifically, the transfer function has a number of "teeth" in the spectral domain where information is retained. Information outside of these teeth is removed.

The comb filter is generated or set up such that it contains the investigated fundamental frequency and its possible harmonics. In other words, the comb filter is generated or set up such that the "teeth" of the comb is found at the investigated fundamental frequency and its possible harmonics.

The harmonic signal is then filtered using the comb filter in step 130. In step 140, the fundamental frequency hypothesis is tested for each tooth in the comb filter. During this test, values predicted from the fundamental frequency hypothesis are compared to values found in the teeth of the comb filter. Based on the deviation of the values predicted and the values in the teeth of the comb filter, a determination is made as to whether the corresponding tooth belongs to the hypothesis or not. A threshold for determining whether the corresponding tooth belongs to the hypothesis may be set either as an absolute value or relative to the predicted values.

If the currently investigated fundamental frequency matches the true fundamental frequency of the signal, all teeth of the comb filter are excited by harmonics. If some teeth are empty (i.e., underlying channels of these teeth were excited by a frequency that is not a harmonic of the fundamental frequency currently being investigated), this is a hint that the fundamental frequency currently being investigated is not the true fundamental frequency of the signal but rather a harmonic or a sub-harmonic.

In order to estimate the true fundamental frequency, all possible fundamental frequencies are tested in the manner described above.

Figure 2:
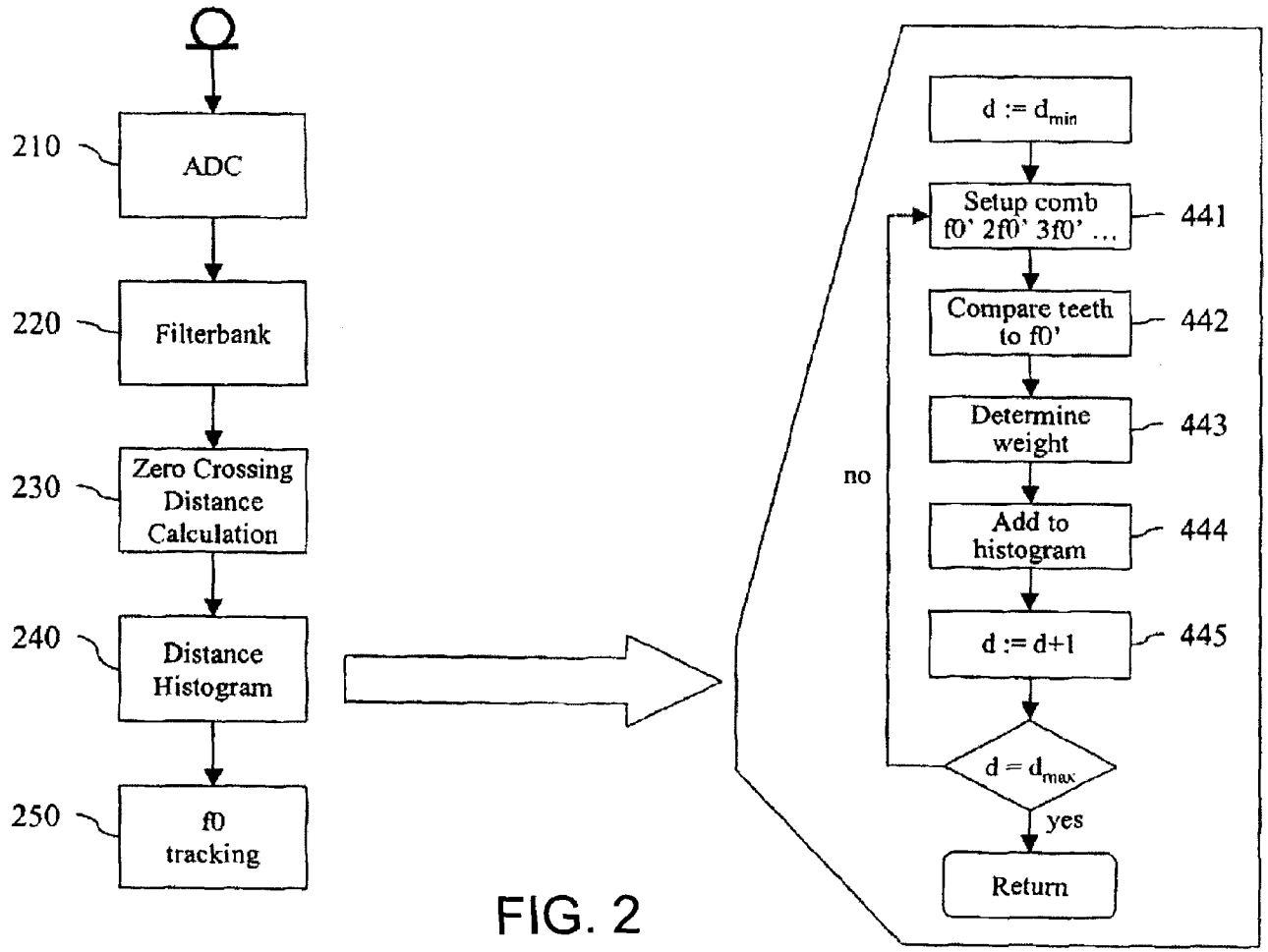
FIG. 2 is a flowchart illustrating a method of estimating the fundamental frequency of a harmonic signal, according to another embodiment of the invention.

FIG. 2 is a flowchart illustrating a method of finding the time course of the fundamental frequency in a harmonic signal more robustly, according to one embodiment. In this method, the fundamental frequency of a harmonic signal is estimated. In particular, the method described above is used in conjunction with the zero crossing based algorithm disclosed, for example, in U.S. patent application Ser. No. 11/340,918 filed on Jan. 26, 2006, entitled "Determination of a common Fundamental Frequency of Harmonic Signals," which is incorporated by reference herein in its entirety. The method describe above may also be used in conjunction with other techniques for determining the fundamental frequency, for example, as disclosed in G. Hu and D. Wang, "Monaural speech segregation based on pitch tracking and amplitude," IEEE Trans. On Neural Networks, 2004, which is incorporated by reference herein in its entirety.

To prepare for the process, the signal may be converted from analog to digital in step 210 and transformed into the frequency domain using a set of band-pass filters or a filter bank in step 220. By transforming in the frequency domain with the filter bank, the signal is split into its frequency components with the resolution given by the filter bandwidths while retaining the temporal information for each of these frequency components that is a band-pass signal. Then, for each band-pass signal, information about its relationship to the current fundamental frequency hypothesis may be gathered.

An embodiment for assessing the relation between the different band-pass signals and the current fundamental frequency hypothesis using zero crossing distances is set forth below.

In order to find the true fundamental frequency, all possible fundamental frequencies need to be scanned and used as fundamental frequency hypotheses. When the distances between the zero crossings are the basis for estimating the fundamental frequency, a reasonable discretization for the fundamental frequencies is the sampling resolution. Let the sampling rate be 16 kHz and the minimal fundamental frequency be 100 Hz. This corresponds to a distance between zero crossings of 160 samples and can be used as the first fundamental frequency hypothesis. The next possible fundamental frequency (the second fundamental frequency hypothesis) has a distance of 159 samples, hence a frequency of 100.3 Hz. The range of possible fundamental frequencies is limited only by the sampling rate of the signal.

For each of the band-pass signals, the zero crossings may be determined in step 230. Also, the distance between consecutive zero crossings may be calculated. This gives a very precise estimate of the dominant or fundamental frequency in the band-pass signal under investigation. Additionally, the distance between three zero crossings may also be calculated and referred to as a second order zero crossing distance. In this way, zero crossing distances may be calculated up to a given order. A practical value for this maximum order is seven (7).

In step 240, a distance histogram is built. First, in step 441, for each fundamental frequency hypothesis scanned, a corresponding comb filter is set up. The comb filter is designed in the frequency domain based on the band-pass signals. A bandpass signal is obtained by passing a signal through a filter having pass-band containing one of the frequencies corresponding to the teeth of the comb-filter are passed through the filter. Other signals not within the pass-band are rejected by the filter. When setting up the comb filter, consideration must be given as to which order zero crossing distances have been calculated so far. Up to this order, teeth are also set up. Let the current fundamental frequency f0' be 100 Hz and the maximum zero crossing distance order be five (5). Then the comb will form the channels corresponding to the frequencies of 100, 200, 300, 400, and 500 Hz (compare with FIG. 3*a*).

In step 442, the zero crossing distances of the channels in the comb filter are compared to the zero crossing distances of the current fundamental frequency. By doing so, the assumed order of the channels on the teeth of the comb may be taken into account (e.g. the 100 Hz channel is compared to the 1st order, the 200 Hz channel is compared to the 2nd order and so forth). Instead of comparing the channels to the current fundamental frequency, an average value as the mean or the median may also be used.

In one embodiment of the invention, the teeth of the comb filter may be labeled either as being excited by a frequency that is a harmonic of the current fundamental or not based on the fundamental frequency currently under investigation and the actual frequency values measured in the comb filter channels. In other words, depending on the deviation of each tooth from the comparison value (e.g. the current fundamental frequency), the tooth may be labeled as either belonging to the current fundamental frequency or not. In this comparison, a threshold for the tolerable deviation may be introduced.

When the current fundamental frequency f0' coincides with the true fundamental frequency in the signal f0, then all teeth in the comb may be labeled or set (compare with FIG. 3*b*). If the current fundamental frequency f0' is twice the true fundamental frequency (the first harmonic), then only each second tooth in the comb may be labeled or set (compare with FIG. 3*c*). Finally, if the current fundamental frequency is half the true fundamental frequency (the first sub-harmonic), then all teeth in the comb may be labeled or set and additionally teeth at multiples of half the current fundamental frequency may be labeled or set (compare with FIG. 3*d*). In order to detect the latter case, the frequencies at multiples of half the current fundamental frequency may be included in the comb filter. The allocation of the comb filter extended by the multiples of the first sub-harmonic in the case where the current fundamental is identical to the true fundamental as illustrated in FIG. 3*e*.

In the following step 443, a weight for the found allocation pattern of the comb filter is determined by comparing it to typical allocation patterns found when the current fundamental frequency is a harmonic or sub-harmonic of the true fundamental frequency.

Figure 3:
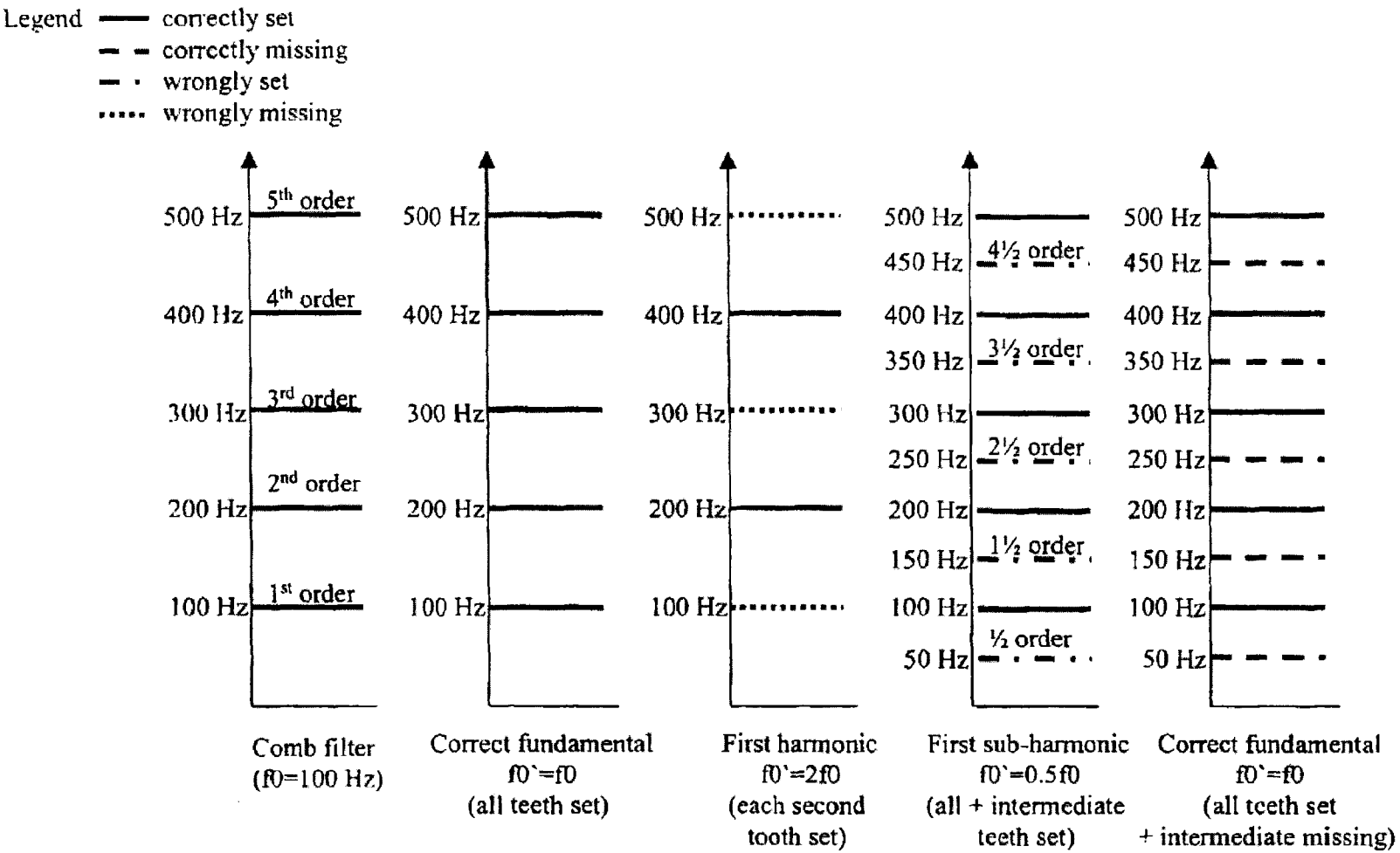
FIG. 3*a* is a diagram illustrating a comb filter with five teeth when the fundamental frequency hypothesis is 100 Hz, according to one embodiment of the invention.
FIG. 3*b* is a diagram illustrating allocation of the comb filter when the fundamental frequency hypothesis and the true fundamental frequency of the signal coincide at 100 Hz, according to one embodiment of the invention.
FIG. 3*c* is a diagram illustrating allocation of the comb filter when the fundamental frequency hypothesis is twice the true fundamental frequency (f0'=200 Hz and f0=100 Hz), according to one embodiment of the invention.
FIG. 3*d* is a diagram illustrating allocation of the comb filter when the fundamental frequency hypothesis is half the true fundamental frequency (f0'=50 Hz and f0=100 Hz) and teeth at multiples of the first sub-harmonic (½) of the fundamental frequency hypothesis are included in the comb, according to one embodiment of the invention.
FIG. 3*e* is a diagram illustrating allocation of the comb filter extended with teeth at multiples of the first sub-harmonic (½) of the fundamental frequency hypothesis when the fundamental frequency hypothesis and the true fundamental frequency of the signal coincide at 100 Hz, according to one embodiment of the invention.

Based on these previously defined prototypical allocation patterns for the comb filter illustrated in FIG. 3, it is possible to formulate rules that penalize the incorrect patterns and thereby enhance the correct pattern. One strategy is to amplify the correct allocation pattern in a non-linear manner. By doing so, the wrong allocation patterns are suppressed. Another approach is to combine the allocations of the teeth in a way that the correct allocation obtains maximal weight and allocations of selected harmonics and sub-harmonics result in a weight of zero.

In other words, based on the allocation patterns, it is possible to develop a method to inhibit these harmonics and sub-harmonics of the true fundamental frequency. It is also possible to use a method that uses the knowledge of the allocation pattern of the teeth of the comb when the tested fundamental frequency is the true fundamental frequency and the typical allocation patterns when the tested fundamental frequency is a harmonic or a sub-harmonic to suppress the peaks of the harmonics and sub-harmonics in the histogram of the tested fundamental frequencies.

In step 444, a two-dimensional histogram is formed. The histogram shows on its x-axis the time. The histogram shows the zero crossing distances of the different fundamental frequency hypotheses on its y-axis. The value displayed in the histogram is their cumulative occurrences. To calculate these cumulative occurrences, the weight determined in step 443 is added to the histogram. Then, the method may continue tracking the fundamental frequency f0 in step 250.

Figure 4:
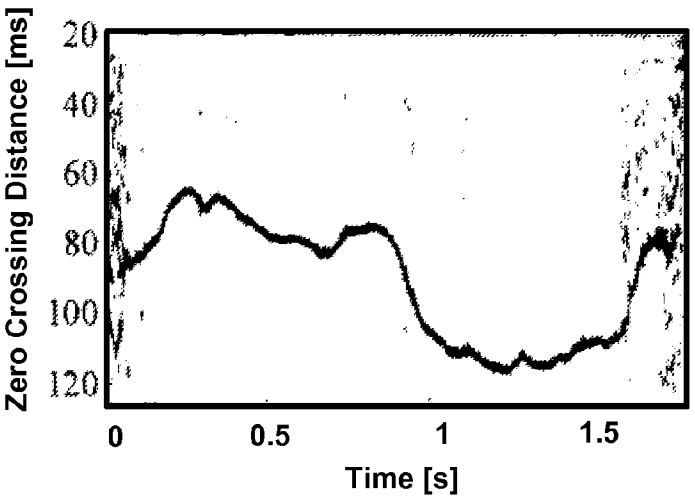
FIG. 4 is a diagram comparing the results of the estimation of the fundamental frequency when the histogram of the zero crossing distances is calculated, according to one embodiment of the invention.
Figure 4:
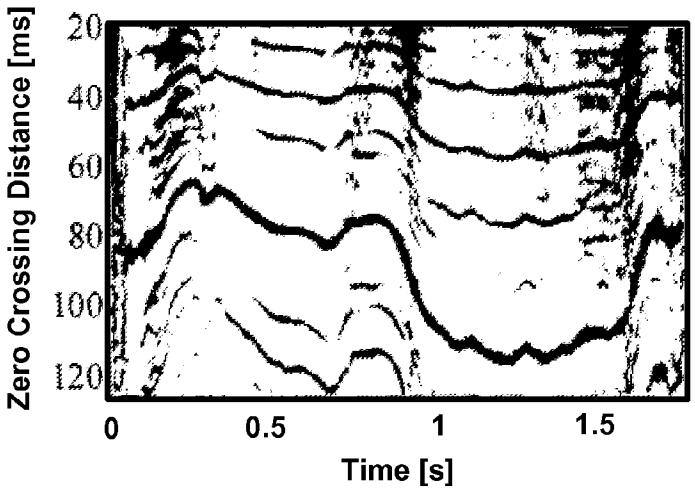

FIG. 4*a* illustrates the results of determining the fundamental frequency based on a histogram of the zero crossing distances calculated using a method as described in U.S. patent application Ser. No. 11/340,918 or a method as described in Martin Heckmann and Frank Joublin, "Sound Source Separation for a Robot Based on Pitch," International Conference on Intelligent Robots and Systems IROS, Edmonton, Canada, August 2005, pp. 203-208. FIG. 4*b* illustrates the results when these methods are used in conjunction with an embodiment of the present invention.

The allocations are combined in a way so that the first harmonic and the first and second sub-harmonics are cancelled. On the x-axis, the time is scaled in terms of seconds. On the y-axis, the distance between zero crossings is scaled in milliseconds. In other words, the two-dimensional histogram illustrates the time on its x-axis and the zero crossing distances of the different fundamental frequency hypotheses on its y-axis. The value displayed on the histogram is their cumulative occurrences. Depending on the method used for extracting the information on the fundamental frequency, the y-axis can also show the lag of the peak of the autocorrelation or some similar indications of the frequency of the fundamental frequency. The illustrated distance values can be converted directly into a frequency.

The significant reduction of the harmonics and sub-harmonics in the histogram is clearly visible in FIG. 4*b*.

In conventional approaches that uses comb filters to extract the fundamental frequency, the precision of the comb filters is determined by the frequency selectivity of the preceding band-pass filters employed to split the signal into frequency bands as described, for example, in H. Duifhuis, L. Willems and R. Sluyter, "Measurement of pitch in speech: An implementation of Goldstein's theory of pitch perception," J. Acoust. Soc. Am. pp. 1568-1580, 1982. The conventional approaches are subject to a trade-off between selectivity and rise time of the filters. Neglecting other effects, increasing rise time limits the selectivity that can be achieved. When the zero crossing distances of the band-pass signals is additionally used to estimate the dominant frequency, the selectivity can be improved without increasing the rise time. The step of labeling the teeth with the fundamental frequency with a precision higher than the precision achieved by the band-pass filters clearly distinguishes embodiments of the present invention from conventional methods where such labeling was not performed and subsequent inhibition was not possible.

Embodiments of the present invention can be implemented as a computing system supplied with signals representing the sound signal to be processed and outputting a signal indicating the estimated fundamental frequency. This output signal can then be used for different applications such as for separating sound sources, for speech recognition, and artificial hearing aids.

While particular embodiments and applications of the present invention have been illustrated and described herein, it is to be understood that the invention is not limited to the precise construction and components disclosed herein and that various modifications, changes, and variations may be made in the arrangement, operation, and details of the methods and apparatuses of the present invention without departing from the spirit and scope of the invention as it is defined in the appended claims.

What is claimed is:

1. A computer-implemented method of estimating a fundamental frequency of a harmonic signal, comprising:

forming a hypothesis for a fundamental frequency of a harmonic in an input signal;

generating a comb filter based on the formed hypothesis;

filtering the input signal by the comb filter;

testing the hypothesis based on the filtered input signals in all teeth of the comb filter; and generating an output signal representing an estimated fundamental frequency of the input signal based on the testing of the formed hypothesis; and wherein testing the hypothesis comprises, for each tooth of the comb filter, comparing a predetermined threshold value with a difference between a first value in each tooth of the comb filter and a second value predicted from the hypothesis.

2. The method of claim 1, wherein the hypothesis of the fundamental frequency is formed based on the sampling resolution of the signal.

3. The method of claim 1, wherein the comb filter includes the hypothesis of the fundamental frequency and possible harmonics of the fundamental frequency.

4. The method of claim 1, wherein the predetermined threshold value is set adaptively depending on disturbances in the input signal.

5. The method of claim 1, wherein testing the hypothesis comprises comparing a predetermined threshold value with a difference between a corresponding order of distances between zero crossings of the input signal at the tooth of the comb filter and distances between zero crossings of the input signal predicted from the hypothesis.

6. The method of claim 5, wherein the threshold value is set adaptively depending on disturbances in the input signal.

7. The method of claim 1, wherein testing the hypothesis comprises comparing a predetermined threshold value with a difference between a peak position of autocorrelation of the input signal at the tooth of the comb filter and a peak position of autocorrelation of the input signal predicted from the hypothesis.

8. The method of claim 7, wherein the threshold value is set adaptively depending on disturbances in the input signal.

9. The method of claim 1, further comprising assigning a weight to the hypothesis based on prototypical allocation patterns of teeth of the comb filter for harmonics and sub-harmonics.

10. The method of claim 9, wherein a correct allocation pattern is amplified in a non-linear manner.

11. The method of claim 9, wherein the weight depends on energy of the input signal at a tooth of the comb filter.

12. The method of claim 1, wherein a histogram of calculated weights is built for each time interval.

13. A non-transitory computer readable storage medium storing a computer program product including computer instructions adapted to estimate a fundamental frequency of a harmonic signal, the computer instructions when executed configured to cause a processor to:

form a hypothesis for a fundamental frequency of a harmonic in an input signal;

generate a comb filter based on the formed hypothesis;

filter the input signal by the comb filter;

test the hypothesis based on the filtered input signals in all teeth of the comb filter; and generate an output signal representing an estimated fundamental frequency of the input signal based on the testing of the formed hypothesis; and wherein testing the hypothesis comprises, for each tooth of the comb filter, comparing a predetermined threshold value with a difference between a first value in each tooth of the comb filter and a second value predicted from the hypothesis.

14. A system for estimating the fundamental frequency of a harmonic signal, comprising:

means for forming a hypothesis for a fundamental frequency of a harmonic in an input signal;

means for generating a comb filter based on the formed hypothesis;

means for filtering the input signal by the comb filter;

means for testing the hypothesis based on the filtered input signals in all teeth of the comb filter; and means for generating an output signal representing an estimated fundamental frequency of the input signal based on the testing of the formed hypothesis; and wherein testing the hypothesis comprises, for each tooth of the comb filter, comparing a predetermined threshold value with a difference between a first value in each tooth of the comb filter and a second value predicted from the hypothesis.

* * * * *